United States Patent [19]

Mengshoel et al.

[11] Patent Number: 4,767,160

[45] Date of Patent: Aug. 30, 1988

[54] DEVICE FOR USE IN A KNEELING-LIKE SITTING POSITION

[76] Inventors: Hans C. Mengshoel, Bygdøy Allé 12, N-0262 Oslo 2; Peter Opsvik, Høgtunveien 12, N-1370 Asker, both of Norway

[21] Appl. No.: 829,537

[22] Filed: Feb. 13, 1986

[30] Foreign Application Priority Data

Feb. 18, 1985 [NO] Norway ..... 850641

[51] Int. Cl.[4] ..... A47C 7/50

[52] U.S. Cl. ..... 297/423; 248/188.7; 297/172; 297/437

[58] Field of Search ..... 297/423, 432, 437, 438, 297/439; 248/188.7, 188.8

[56] References Cited

U.S. PATENT DOCUMENTS

| | | | |
|---|---|---|---|
| 590,268 | 9/1897 | Lee | 297/437 |
| 1,537,980 | 2/1926 | Liptag | 297/438 X |
| 1,606,840 | 11/1926 | Koenigkramer | 297/423 X |
| 1,608,033 | 11/1926 | Nabors | 297/423 |
| 4,328,991 | 5/1982 | Mengshoel et al. | 297/423 X |
| 4,425,863 | 1/1984 | Cutler | 297/439 X |
| 4,589,699 | 5/1986 | Dungan | 297/423 |

*Primary Examiner*—Kenneth J. Dorner
*Assistant Examiner*—Peter R. Brown
*Attorney, Agent, or Firm*—Darby & Darby

[57] ABSTRACT

A device for use in a kneeling-like sitting position having a per se known, optionally tiltable and optionally height-adjustable chair seat on a chair supporting a person's posterior, and having at least one cushion supporting the person's knee/calf area, said cushion or cushions being supported by a support frame, which preferably is detachably mounted on the frame of the chair or parts of said frame. Optionally, a five-branch crossed base may form part of the chair frame, said support frame being made to engage with the outer section of two of the branches of the crossed base.

3 Claims, 4 Drawing Sheets

DEVICE FOR USE IN A KNEELING-LIKE SITTING POSITION

The present invention concerns a device for use in a kneeling-like sitting position, comprising means of support for a person's posterior and for the knees/calves part.

Devices of the type mentioned in the introduction are known, inter alia, from the Norwegian Pat. Nos. 145 126 and 145 973.

However, it has become evident that there is a need for the opportunity of creating a kneeling-like sitting position in connection with a per se conventional chair, for instance an office chair, without necessarily having to purchase a whole new chair for the purpose.

Thus, the present invention is intended to meet this need, and the distinctive features of the invention will be apparent from the subsequent patent claims and from the subsequent description with reference to the enclosed drawings, while said drawings only serve as an illustration of the idea of the invention, and are to be regarded as unrestricting examples with respect to the invention.

The embodiment examples according to FIGS. 1–6 are, as shown, related to office chairs.

Figure 7:
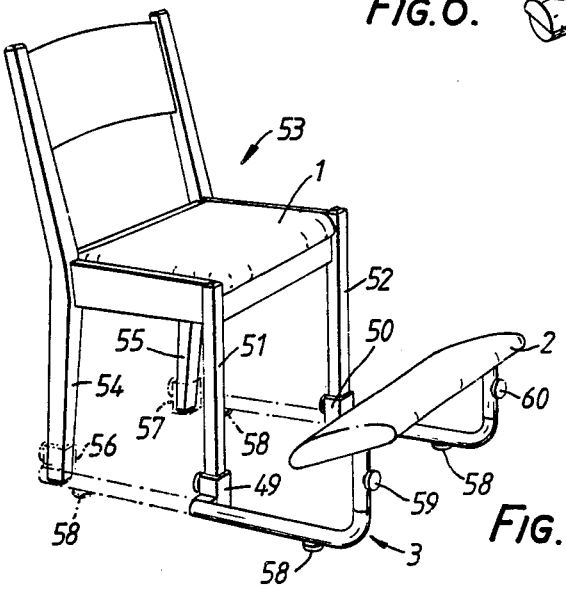
FIG. 7 illustrates a seventh embodiment example of the device according to the invention.

The embodiment example according to FIG. 7 is related to a per se conventional chair with four downward pointing legs.

Each individual embodiment example will now be described one at a time. The means of support for the posterior consists, in all the embodiment examples, of a per se known chair seat 1 of a chair, said chair seat being optionally tiltable forwards/backwards. The means of support for the knees/calves parts consists, in all the embodiment examples, of a cushion 2 whose support frame is indicated, in all the embodiment examples, by the reference number 3, and which preferably is detachably mounted on the frame 4 of the chair or on parts of said frame.

Figure 1:
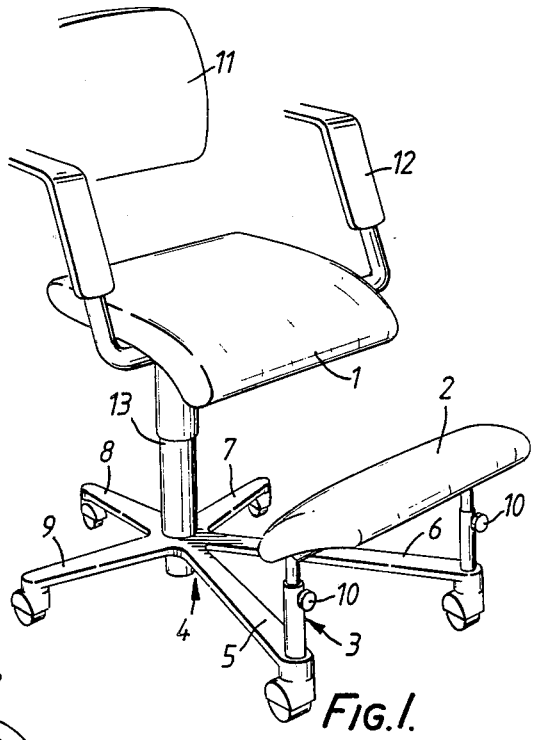
FIG. 1 illustrates an initial embodiment example of the device according to the invention.

In the embodiment example according to FIG. 1, a five-branch crossed base, of which two of the branches 5 and 6 have a greater length than the remaining three 7,8, and 9, has been included in the frame of the chair. As will be apparent from the drawing, the support frame 3 engages with the outer parts, respectively, of the two branches 5 and 6. This may be achieved by having the support frame 3 consist, for instance, of tubes which may be inserted into holes in said branches 5 and 6. The cushion 2 may optionally be made height-adjustable, to be locked in the desired position by means of adjustable screws 10. The chair seat 1 with its back rest 11, arm rests 12 and supporting column 13, for instance of an adjustable kind, are all parts which are per se known from conventional office chairs.

It is shown in FIG. 1 that the cushion is supported by a support frame having at least two support arms 5 and 6. Each support arm has one end connected to the central portion of the chair frame and a second free end. The support arms 5 and 6 are exposed to each other at a substantial angle so that the central portion of the chair frame and the free end of each arm define a substantially elongated triangle.

Figure 2:
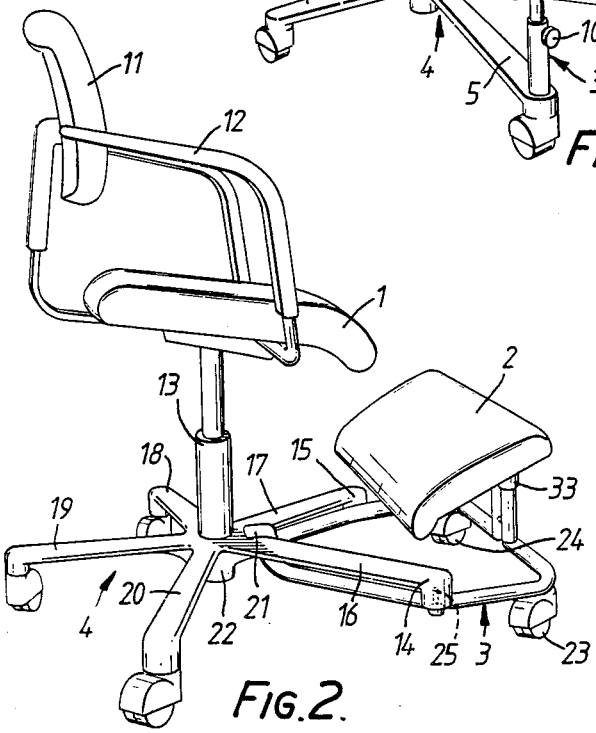
FIG. 2 illustrates a second embodiment example of the device according to the invention.

The solution according to FIG. 2 deviates somewhat from the solution according to FIG. 1, in that a crossed base having at least four branches is included in the chair frame. However, in the example shown, five branches have been utilized, which would be preferable in most cases from the point of view of stability. In FIG. 2, said support frame 3 engages with the outer sections 14 and 15, respectively, of two of the branches 16 and 17, respectively, of the crossed base, while the remaining three branches 18–20 of the embodiment example are unaffected by the support frame 3. Moreover, the support frame engages with the section where the branches 16, 17 meet, for instance by the frame 3 having a hook-like organ 21 attaching the innermost section of frame 3 to the crossed base. Alternatively, but not shown as an embodiment, said inner section of the support frame 3 may be optionally attached to the middle section 22 of the crossed base. The support frame 3 reaches, as shown in FIG. 2, past the respective outer sections 14, 15 of the branches 16, 17, and is provided with casters 23, 24 on its underside. The engagement between the outer sections 14, 15 of said branches 16, 17 and the frame 3 takes place by means of the removal of the casters which are normally attached to said outer sections 14, 15, see the example concerning the branches 18, 19, 20, and by means of an appropriate engaging organ on the frame, such as taps 25 (shown in broken line) protruding into the per se known attachment holes for the casters in said outer sections 14, 15.

Figure 3:
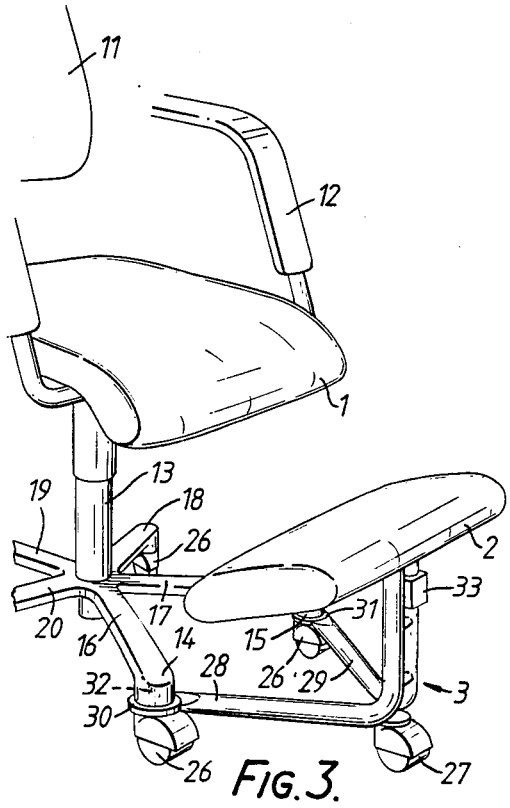
FIG. 3 illustrates a third embodiment example of the device according to the invention.

In the solution according to FIG. 3, a crossed base, having at least four branches provided at their outer sections with casters, forms part of the chair frame. In the embodiment example in FIG. 3, a crossed base having five branches in all has been selected. A crossed base corresponding to the one shown in FIG. 2 may be used. The drawing only shows casters 26 in connection with the branches 16, 17, 18, the branches 19 and 20 not being drawn in their entirety. The support frame 3 in FIG. 3 has been provided with at least one caster 27 on its underside, and has two branches 28, 29 having organs 30, 31 designed to engage with the outer sections 14, 15 of said branches 16, 17. As indicated in FIG. 3, said organs 30, 31 might be embodied as horizontally situated rings designed to enclose the upwardly protruding attachment tap of the respective casters (26), indicated by the reference number 32.

Common to the embodiment examples in FIGS. 1–3 is the individual height-adjustability of both the chair seat 1 and the cushion 2, in that, in the solution, adjustment means 33, according to the FIGS. 2 and 3, have been provided in connection with the upwardly protruding sections of the support frame 3.

Figure 4:
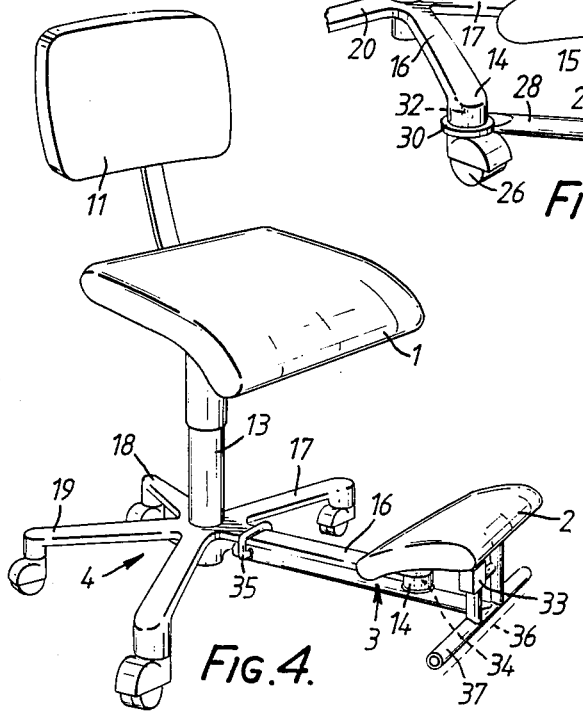
FIG. 4 illustrates a fourth embodiment example of the device according to the invention.

In the embodiment example according to FIG. 4, the chair frame 4 also consists of a crossed base having at least four branches, 5 branches having been used in the selected example, however. In the solution shown here, a per se conventional crossed base is being used, and, in order to achieve the best possible balance, said crossed base should preferably have five branches. As will be apparent from the figure, the support frame 3 engages with only one of the said branches, indicated in the example by 16. At the outer section 14 of the branch 16, the frame 3 has a tap 34 which has been inserted into the per se known caster attachment hole of the branch 16, and which has been screwed on to or pressed on to the branch 16 by means of an attachment member 35 at a section further in on said branch. The attachment member 35 may for instance consist of a hoop-shaped member which grips the upper side of the branch 16, and which may be attached and tightened on the underside of the frame 3.

The reference number 36 indicates the level of a floor on which the chair with the present device is placed. The frame 3 may be provided with an outwardly protruding member 37, in such a way that said member will engage with the floor 36 when a load is put on the cushion 2. As is also shown in the previous drawings, the seat 1 may be supported by, for example, a device 13 of infinitely variable adjustability, and the cushion 2 at the vertical section of the frame 3 has been provided with level adjustment means 33.

Figure 5:
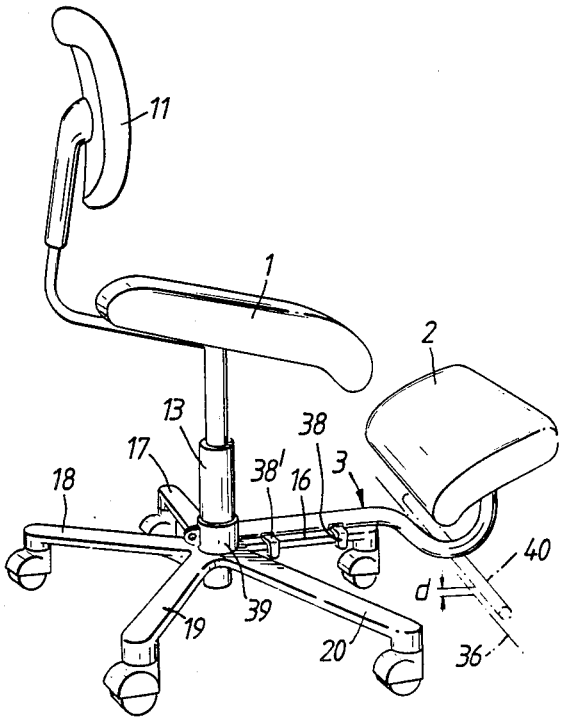
FIG. 5 illustrates a fifth embodiment example of the device according to the invention.

The solution in FIG. 5 should more or less be regarded as a variant of the solution shown in FIG. 4. Instead of attaching the frame 3 on the underside of the branch 16, the frame 3 has been placed on the upper side of the branch 16 and anchored sideways to the branch by means of support organs 38, for instance angle irons. Said angle irons should of course protrude down on each side of the branch 16. If it is desired, a second pair of such angle irons may be added, as indicated by 38'. At the innermost section, the frame 38 has been attached by means of a mounting 39 to the supporting column 13 which supports the chair seat 1. As indicated in connection with FIG. 4, a member 40 may be arranged at the front section of the underside of the frame 3, said member being such a short distance d from the floor 36 that when a person puts a load on the cushion 2, said member 40 is brought into frictional contact with the ground, whereby the kneeling-like sitting position is further stabilized.

Even though it has not been shown in FIG. 4 or FIG. 5, casters may be optionally provided on the underside of the frame, for instance near the outer sections of said members 37 and 40 respectively, as is also indicated in FIGS. 2 and 3.

Figure 6:
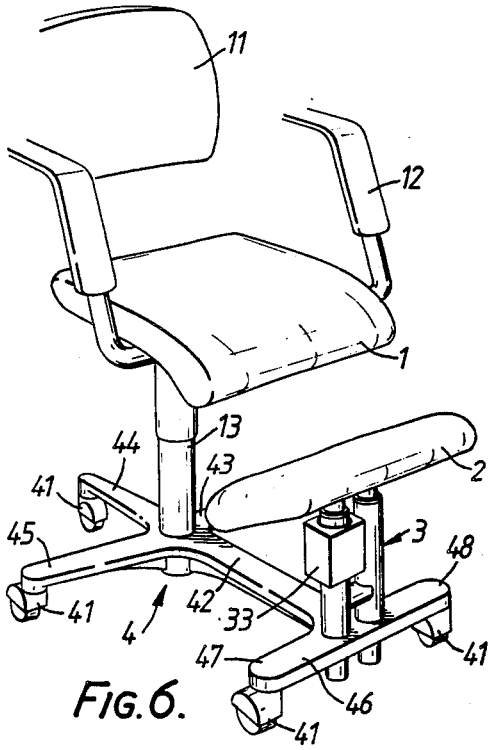
FIG. 6 illustrates a sixth embodiment example of the device according to the invention.

The solution shown in FIG. 6 according to the invention, is in reality a solution which demands that a chair frame be provided, consisting of a crossed base having casters 41 and at least four branches 42, 43, 44, 45. In the embodiment example shown, it will be preferable to have four branches instead of five branches for the sake of the placing of the chair user's feet. There is not, per se, any objection to having the specially designed crossed base, as shown in FIG. 6, as an ordinary crossed base for an office chair, which would ascertain further stability in that the branch 42 becomes a cross piece 46 at its outer end, said cross piece 46 being provided with the respective casters at its respective outer sections 47, 48, the middle section of the cross piece being designed so as to engage with the support frame 3 for the cushion 2. As in the embodiment according to FIGS. 2–4, both the seat 1 and the cushion 2 are level-adjustable, by means of the adjustable support column 13 and the adjustment means 33 respectively.

It is illustrated by FIG. 6 that the cushion 2 is supported by a support frame having a substantially T-shaped configuration. The support frame has a central portion 42 and a curved portion 48. The central portion has a length substantially longer than the length of the branches 44 and 45. This is necessary to provide an adequate space for movement of the legs of the user. The cross-section 48 has rolling arrangement 41 at both free ends thereof and has a support unit for slidable receiving of the engaging members of the cushion.

The solution according to FIG. 7 is mostly shown to illustrate how the present invention may be adapted to a per se known chair, for instance of the type where the chair has been provided with at least 3, preferably 4 downwardly protruding legs, and where the frame 3 has been provided with attachment members 49, 50, which may be attached, for instance, to the front legs 51, 52, of the chair 53. Furthermore, the broken lines indicate how the frame 3 might also be led backwards towards the rear legs 54, 55 of the chair, there to be attached to said rear legs 54, 55 by means of attachment members 56, 57. In the latter solution, it may be expedient to provide the frame 3 with casters or similar means 58, as indicated. Optionally, the cushion 2 may be made height-adjustable by means of adjustment members 59, 60, arranged on the upwardly protruding sections of the frame. It would optionally be natural to attach said casters 58 in such a way that the frame 3 is at the shortest possible distance from the floor.

Within the framework of the invention, further embodiments and modifications of the embodiment examples shown in the FIGS. 1–7 would be conceivable. The cushion 2 might for instance be designed as two cushions separate one from the other.

Having described our invention, we claim:

1. A furniture arrangement for use in a kneeling-like sitting position, comprising a chair having a seat, a chair frame and a support column, said chair frame having at least four branches extending from a central portion of the chair frame and forming a single, unitary structure at said central portion, two of said branches having a length substantially longer than the length of the remaining of said at least four branches and defining two support frame arms each having a free end remote from said central portion;

supporting means to support the person's knee and calf area having at least one cushion, the cushion having engaging means, and being supported by said support frame arms at the free ends thereof and in such a way as to provide an adequate space for movement of the legs of the user, said two arms defining a substantial angle so that the central portion of the chair frame and said free end of each arm define a substantially elongated triangle to enhance the stability of the arrangement, and a receiving unit extending from each said free end of each arm to slidably receive said engaging means of the cushion, at least one rolling means being provided at each end free of said arms and at each free end of said remaining branches, said rolling means being rotatable relative to said free ends and along a surface of a floor supporting said arrangement.

2. A device as disclosed in claim 1 characterized in that the support frame has been provided with means to make said knee/calf supporting cushion height-adjustable.

3. An arrangement according to claim 1 wherein a longitudinal axis of each receiving unit is substantially parallel to an axis of a support column of the chair.

* * * * *